US007743939B2

(12) United States Patent
Stahl

(10) Patent No.: US 7,743,939 B2
(45) Date of Patent: Jun. 29, 2010

(54) NESTABLE BEVERAGE CASE

(75) Inventor: Edward L. Stahl, Tyler, TX (US)

(73) Assignee: Orbis Canada Limited, Toronto (CA)

( * ) Notice: Subject to any disclaimer, the term of this patent is extended or adjusted under 35 U.S.C. 154(b) by 1058 days.

(21) Appl. No.: 11/406,568

(22) Filed: Apr. 19, 2006

(65) Prior Publication Data

US 2007/0246392 A1 Oct. 25, 2007

(51) Int. Cl.
*B65D 1/24* (2006.01)
*B65D 1/36* (2006.01)
*B65D 21/00* (2006.01)

(52) U.S. Cl. ..... 220/518; 220/509; 206/519

(58) Field of Classification Search ..... 220/509; 206/516, 518, 519
See application file for complete search history.

(56) References Cited

U.S. PATENT DOCUMENTS 4,899,874 A 2/1990 Apps et al.
4,932,532 A 6/1990 Apps et al.
4,978,002 A 12/1990 Apps et al.
5,060,819 A 10/1991 Apps
5,071,026 A 12/1991 Apps
5,184,748 A 2/1993 Apps
5,230,601 A 7/1993 Apps et al.
5,267,649 A 12/1993 Apps et al.
5,277,316 A 1/1994 Apps et al.
5,285,899 A 2/1994 Apps et al.
5,305,884 A 4/1994 Apps et al.
5,316,172 A 5/1994 Apps et al.
5,323,925 A 6/1994 Apps
5,351,814 A 10/1994 Apps
5,405,042 A 4/1995 Apps et al.
5,445,273 A 8/1995 Apps
5,465,843 A 11/1995 Koefelda
5,495,945 A 3/1996 Apps et al.
5,529,176 A 6/1996 Apps et al.
5,575,390 A 11/1996 Apps et al.
5,651,461 A 7/1997 Apps et al.
5,660,279 A 8/1997 Apps et al.
5,704,482 A 1/1998 Apps et al.
5,842,572 A 12/1998 Apps et al.
5,855,277 A 1/1999 Apps et al.
5,979,654 A 11/1999 Apps
6,073,793 A 6/2000 Apps et al.
6,131,730 A 10/2000 Hsu
6,186,328 B1 2/2001 Apps (Continued)

*Primary Examiner*—Anthony Stashick
*Assistant Examiner*—Shawn M Braden
(74) *Attorney, Agent, or Firm*—Ungaretti & Harris LLP

(57) ABSTRACT

A nestable mid-depth beverage case has a bottom wall with upstanding side and end walls around its periphery and a plurality of container seating areas on its top surface. A continuous peripheral band forms a vertical upper wall section, and a plurality of spaced apart V-shaped columns connected between the bottom wall and the band form a lower wall section inset relative to the upper section to enable nesting of the container. Buttresses extend upwardly from the columns and across the band. The columns have flat, angled vertical surfaces facing toward adjacent seating areas to contact containers over a substantial part of their height and provide support in lateral and longitudinal directions. Each end wall has two columns and associated buttresses, and a handle with a large access opening is formed in each end wall by cutting away adjacent side edges of adjacent columns and buttresses and the bottom edge of the band.

16 Claims, 7 Drawing Sheets

U.S. PATENT DOCUMENTS

| | | | | |
|---|---|---|---|---|
| 6,237,758 | B1 | 5/2001 | Hsu | |
| D462,522 | S | 9/2002 | Apps et al. | |
| 6,457,599 | B1 | 10/2002 | Apps et al. | |
| D487,634 | S | 3/2004 | Apps et al. | |
| 6,892,885 | B2 | 5/2005 | Apps et al. | |
| 6,899,247 | B1 | 5/2005 | Koefelda et al. | |
| 6,966,442 | B2 | 11/2005 | Hassell et al. | |
| 7,017,746 | B2 | 3/2006 | Apps | |
| 7,322,475 | B2 * | 1/2008 | Hassell et al. | 206/515 |
| 2001/0015329 | A1 | 8/2001 | Apps et al. | |
| 2001/0019063 | A1 | 9/2001 | Apps | |
| 2002/0195452 | A1 | 12/2002 | Apps | |
| 2003/0029870 | A1 | 2/2003 | Apps et al. | |
| 2003/0057211 | A1 | 3/2003 | Koefelda et al. | |
| 2003/0070957 | A1 * | 4/2003 | Apps et al. | 206/518 |
| 2005/0040069 | A1 | 2/2005 | Apps et al. | |
| 2005/0067314 | A1 | 3/2005 | Koefelda et al. | |

* cited by examiner

NESTABLE BEVERAGE CASE

RELATED APPLICATIONS

N/A

TECHNICAL FIELD

This invention relates to beverage cases. More specifically, the invention relates to a half-depth or mid-depth molded plastic beverage case that is fully nestable with like beverage cases, partially nestable with prior art non-nestable "box-style" beverage cases, and stackable with prior art box-style cases.

BACKGROUND ART

Beverages are commonly packaged in containers ranging in size from about six ounces up to about two liters, although different size containers are sometimes used. To facilitate handling, these containers typically are placed in cases that normally hold from eight to twenty-four containers, depending upon the size of the containers and the style of the case.

Reusable molded plastic cases capable of holding the desired number of containers have been developed in the prior art. These cases have a bottom wall or floor and upstanding side and end walls around the periphery of the floor. Cases designed for smaller containers generally are of low-depth construction, and typically have tapered or outwardly inclined sidewalls so that the cases can nest with one another. Other cases that have been developed primarily for use with larger containers have a higher sidewall, i.e., approximately mid-depth construction, with a sidewall that is about one-half the height of beverage containers placed in the case. The sidewalls in these cases generally are vertical and of substantially uniform height. This type of case is referred to in the industry as a "box-style" case and is commonly used for holding containers of one liter size, although they could be designed to hold containers of other sizes, including from about twenty ounces up to two or three liters, for example. These box-style cases do not nest with each other or with cases or boxes of other designs. They do, however, have shallow interengaging structure at their tops and bottoms that permit the bottom of an upper box to extend about ⅜ of an inch into the top of a lower box, permitting the boxes to be stacked in stable relationship with one another.

The inability of box-style cases to nest requires a substantial amount of space for storage and shipment of the cases when empty, leading to increased cost in their use. Moreover, the planar or flat vertical sidewalls typically found in these cases do not provide secure support to containers placed in the case.

It would be desirable, therefore, to have a mid-depth beverage case designed for holding larger beverage containers, wherein the case is nestable and wherein the sidewalls provide secure support to containers placed in the case.

DISCLOSURE OF THE INVENTION

The present invention is a mid-depth beverage case designed for holding larger beverage containers, e.g., from about twenty ounces up to about two liters or more, wherein the case is nestable and wherein the sidewalls provide secure support to containers placed in the case.

In a preferred embodiment, the invention comprises a nestable mid-depth case for bottles, comprising a floor having a top surface, a bottom surface, and an outer perimeter, wherein the top surface has a plurality of bottle seating areas formed thereon, and the bottom surface has a plurality of recessed closure receiving areas formed thereon for receiving bottle closures in a subjacent crate. A mid-depth wall extends around the perimeter of the floor, and comprises opposed sidewalls and opposed end walls, each of the sidewalls and end walls having an upper wall section extending perpendicular to the floor and a lower wall section extending perpendicular to the floor. The lower wall section comprises a plurality of spaced apart vertical columns having angularly disposed flat vertical surfaces facing toward adjacent seating areas. The upper wall section comprises a band having a top edge and a bottom edge, and inwardly projecting nesting buttresses extending upwardly along an inner surface of the band in axial alignment with associated columns. Recessed areas are in the bottom edge of the band at a midportion of each end wall and in adjacent side edges of a pair of adjacent columns and associated nesting buttresses in the end walls, forming a handle bar at the top of each end wall and an enlarged opening extending between the handle bar and the floor and between the pair of adjacent columns.

In particular, the case of the invention has a bottom wall or floor, with upstanding sidewalls and end walls around the periphery of the floor, and handles in the end walls. The floor comprises an open grid-like structure formed by a plurality of intersecting longitudinal, transverse, and diagonal ribs, with a plurality of spaced apart circular seating areas on its top surface on which the beverage containers rest, and closure receiving recesses in its bottom surface beneath the seating areas for receiving the closures of beverage containers in a subjacent case. The closure receiving recesses are defined by undercut sections of the longitudinal and transverse ribs where they cross under respective seating areas. Each of the closure receiving recesses is larger in diameter than the closure of a beverage container and is therefore incapable by itself of aligning the closures of beverage containers in a subjacent case. However, the closure receiving recesses under different seating areas are offset different amounts relative to the centerline of an associated seating area, with the recesses offset progressively greater distances toward an adjacent outer edge of the case as the distance of the recess from the longitudinal and transverse centerlines of the case increases, whereby the closure receiving recesses acting together on the closures in a subjacent case function to align the closures of the containers in the subjacent case with the centerline of respective seating areas in the upper case. Further, the ribs at the outer side edges of the closure receiving recesses along the side and end edges of the case bottom are cut away, defining channels through which closures can easily slide when an upper case loaded with beverage containers is slid off the top of another case loaded with beverage containers.

The sidewalls and end walls each comprise upper and lower wall sections, with each section extending over approximately one-half the height of the wall, and the lower section inset relative to the upper section. The upper section comprises a continuous vertical band extending around the case, and the lower section comprises a plurality of spaced apart vertical columns connected between the band and the floor in locations between adjacent seating areas. The columns are generally V-shaped in transverse cross-section, with angularly oriented flat vertical surfaces facing toward respective adjacent seating areas, and the V opening outwardly of the case. Correspondingly shaped hollow buttresses extend upwardly from the upper ends of the columns and across substantially the width of the inner face of the band, but terminate at their upper ends spaced from the upper edge of the band.

The inset lower section enables one case to nest into another like case and to nest into conventional box-style cases up to approximately one-half its height. Further, the interior upper edge of the band is outwardly recessed and tapered, providing space for receiving the bottom of a conventional box-style case so that a conventional box-style case can be stacked with the case of the invention.

The inwardly facing flat vertical surfaces of the V-shaped columns provide line contact with beverage containers resting on respective adjacent seating areas and provide support to the containers over a substantial portion of their height in both longitudinal and lateral directions relative to the case.

The band that forms the upper section of the walls is of single wall construction, comprising alternating inwardly and outwardly offset panels. The outwardly offset panels extend behind or outwardly of the buttresses and have flat vertical outer surfaces. The inwardly offset panels are located adjacent the seating areas and are outwardly curved.

Two columns and associated buttresses are in each end wall, spaced equidistantly from opposite sides of the case. The confronting side edges of these buttresses, the inner upper edge portions of the two columns, and the bottom of the band extending between the two columns are cut away to form a handle bar extending across an upper midportion of each end wall, with an enlarged opening beneath the bar for easy hand access.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE PREFERRED EMBODIMENT

A beverage case according to the invention is indicated generally at 10 in FIGS. 1-7. The case has a bottom wall or floor 11, with upstanding sidewalls 12 and 13 and end walls 14 and 15 around the periphery of the floor, and handles 16 and 17 in the end walls.

Figure 10:
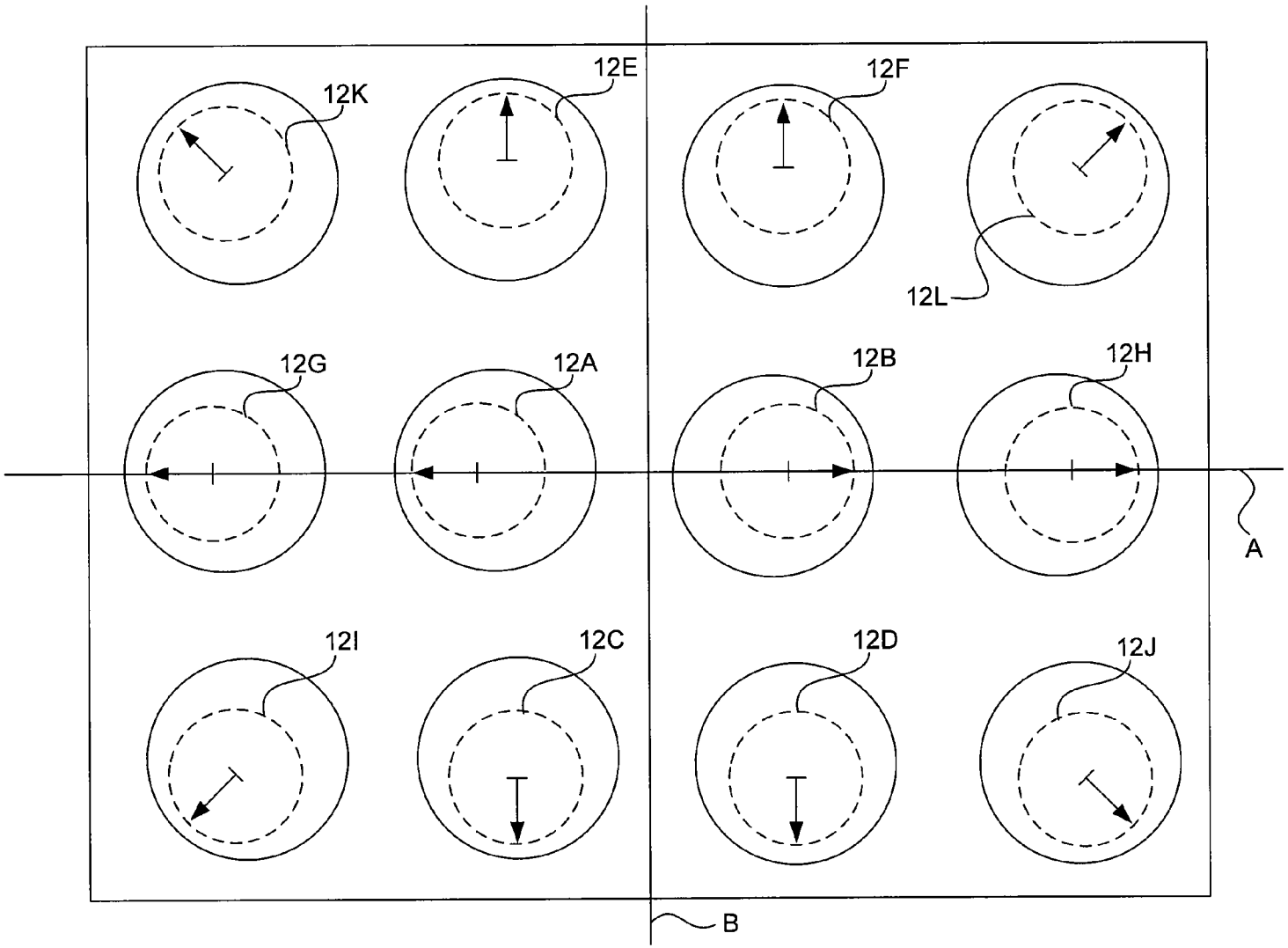
FIG. 10 is a somewhat schematic bottom plan view of the case of FIG. 1, depicting the variably offset relationships of the closure receiving recesses relative to the associated seating areas.

The floor comprises an open grid-like structure formed by a plurality of intersecting longitudinal ribs 18, transverse ribs 19, and diagonal ribs 20, with a plurality of spaced apart circular seating areas 21 on its top surface for receiving the beverage containers, and closure receiving recesses 22 in its bottom surface beneath the seating areas for receiving the closures (not shown) of beverage containers in a subjacent case. The closure receiving recesses are defined by undercut sections of the longitudinal and transverse ribs where they cross under respective seating areas. Each of the closure receiving recesses is larger in diameter than the closure of a beverage container and is therefore incapable by itself of aligning the closures of beverage containers in a subjacent case. However, the closure receiving recesses under different seating areas are offset different amounts relative to the centerline of an associated seating area, with the recesses offset progressively greater distances toward an adjacent outer edge of the case as the distance of the recesses from the longitudinal and lateral centerlines A and B, respectively, of the case increases, whereby the closure receiving recesses acting together on the closures in a subjacent case function to align the closures of the containers in the subjacent case with the centerline of respective seating areas in the upper case. Thus, with particular reference to FIGS. 2 and 10, the closure receiving recesses 12A and 12B lying on the longitudinal centerline A and closest to the lateral centerline B on opposite sides thereof are slightly offset along the longitudinal centerline away from the lateral centerline and away from the centerlines of the respective seating areas 21 toward the respective adjacent ends of the case. Similarly, the closure receiving recesses 12G and 12H spaced farther away from the lateral centerline and adjacent respective opposite ends of the case are offset along the longitudinal centerline a slightly greater amount from the centerlines of their respective associated seating areas. The closure receiving recesses 12C, 12E and 12D, 12F located between the recesses 12A and 12B, respectively, and adjacent side edges of the case are offset outwardly toward the adjacent side edges, and the closure receiving recesses 12I, 12K and 12J, 12L located in the corners of the case are offset diagonally outwardly toward respective adjacent corners. The progressively greater offset of the closure receiving recesses as their distance from the longitudinal and lateral centerlines increases results in a side of each closure being contacted by the ribs at a corresponding side of a respective recess, causing the closures as a group to be aligned with the seating areas of a case resting on the closures. Further, the ribs at the outer side edges of the closure receiving recesses along the side and end edges of the case bottom are cut away flush with the recesses, defining channels 30 through which closures can easily slide when an upper case loaded with beverage containers is slid off the top of another case loaded with beverage containers.

The sidewalls and end walls each comprise an upper wall section 31 and a lower wall section 32 (see FIG. 4), with each section extending over approximately one-half the height of the wall. The upper section comprises a continuous vertical band 33 extending around the case, and the lower section comprises a plurality of spaced apart vertical columns 34 connected between the band and the floor in locations between adjacent seating areas 21.

The columns are generally V-shaped in transverse cross-section, with flat vertical surfaces 35 and 36 angularly divergent at an angle β of about 90° and facing toward respective adjacent seating areas 21, with the V opening outwardly of the case. The flat vertical surfaces 35 and 36 make line contact over a substantial portion of the height of containers supported in adjacent seating areas, and provide support to the containers in both lateral and longitudinal directions relative to the lateral and longitudinal directions of the case. Correspondingly shaped hollow buttresses 37 extend upwardly from the upper ends of the columns and across substantially the width of the inner face of the band, but terminate at their upper ends spaced from the upper edge of the band.

The lower section is inset relative to the upper section by an amount approximately the same as or slightly greater than the thickness of the material forming the columns, and when an upper case is nested into a lower case the buttresses of the lower case are received in the outer open space of the columns of the upper case. A narrow, flat, generally vertical but slightly outwardly tapered ramp 38 is formed at each side of each buttress, defining a rest or guide for opposite side edges of the V-shaped columns when two cases are nested together. The transition between the upper ends of the columns and the lower ends of the buttresses is defined by a slightly upwardly and outwardly angled shoulder 39 that defines a nesting stop to limit nesting engagement of the cases.

The inset bottom half of the case sidewall enables the case of the invention to be nested up to one-half its height with like cases, and also enables the case of the invention to be nested up to one-half its height within conventional box-style cases.

Further, the interior upper edge 40 of the band is outwardly recessed and tapered, providing space for receiving the bottom of a conventional box-style case (not shown) so that a conventional box-style case can be stacked on the case of the invention.

The inwardly facing flat vertical surfaces 35 and 36 of the V-shaped columns forming the lower section of the sidewalls and end walls contact beverage containers on the adjacent seating areas and provide support to the containers over a substantial portion of their height in both longitudinal and lateral directions relative to the case.

Figure 1:
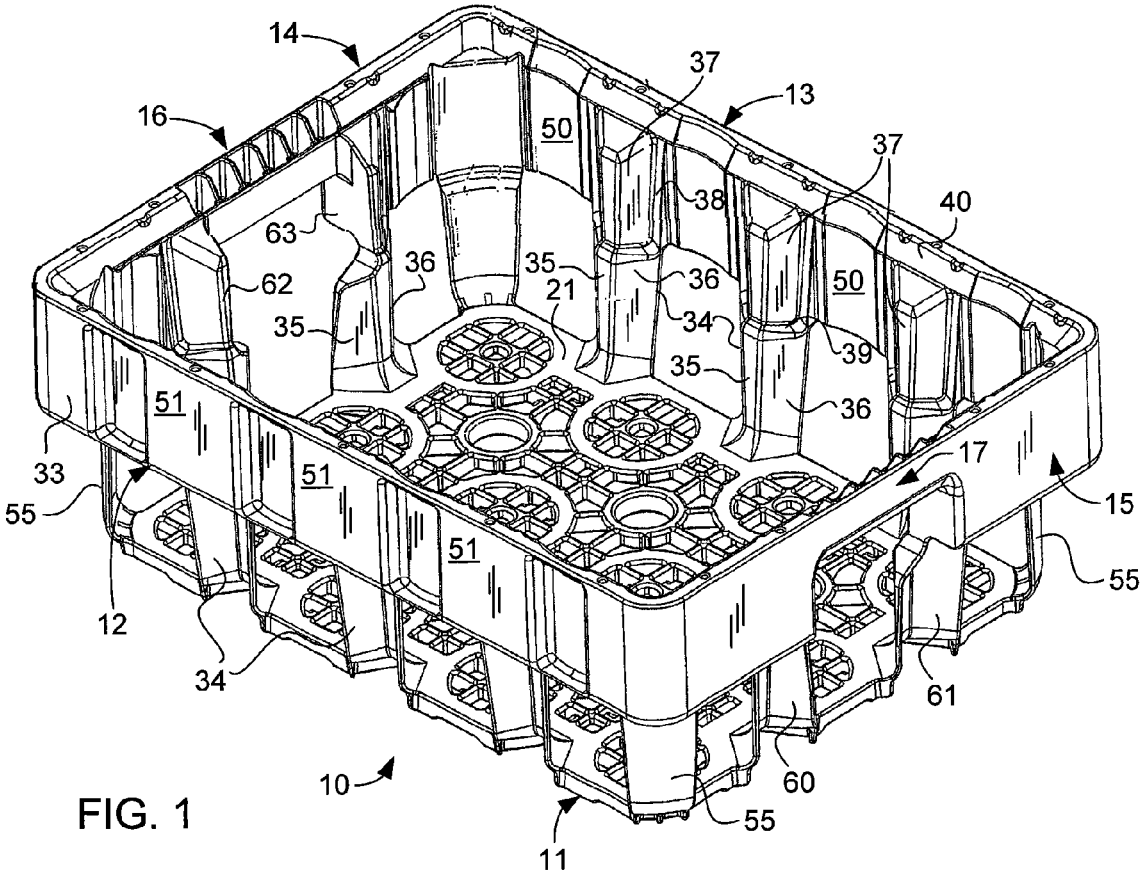
FIG. 1 is a top perspective view of a mid-depth beverage case according to the invention.
Figure 2:
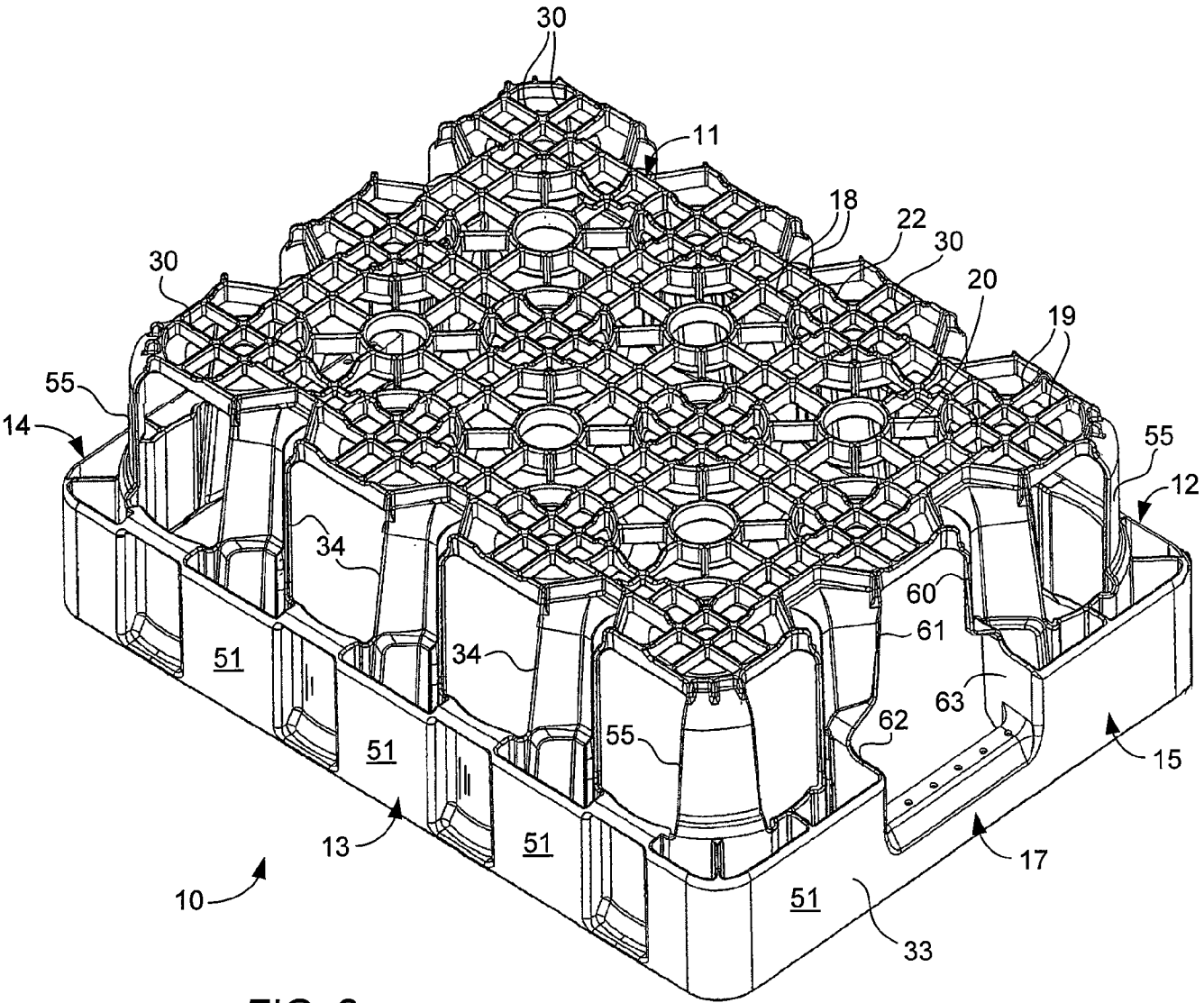
FIG. 2 is a slightly enlarged bottom perspective view of the case of FIG. 1.
Figure 3:
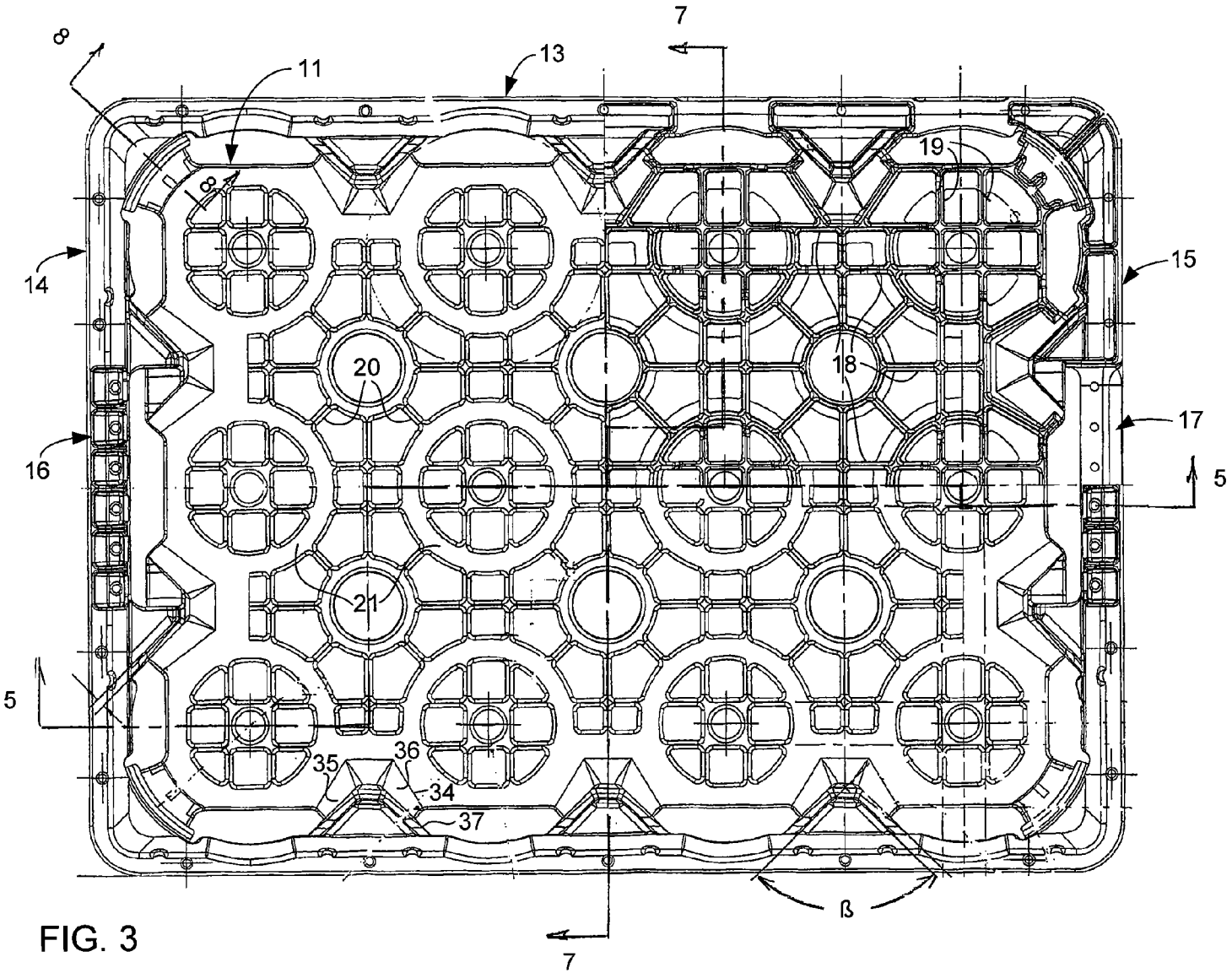
FIG. 3 is an enlarged top plan view of the case of FIG. 1.
Figure 4:
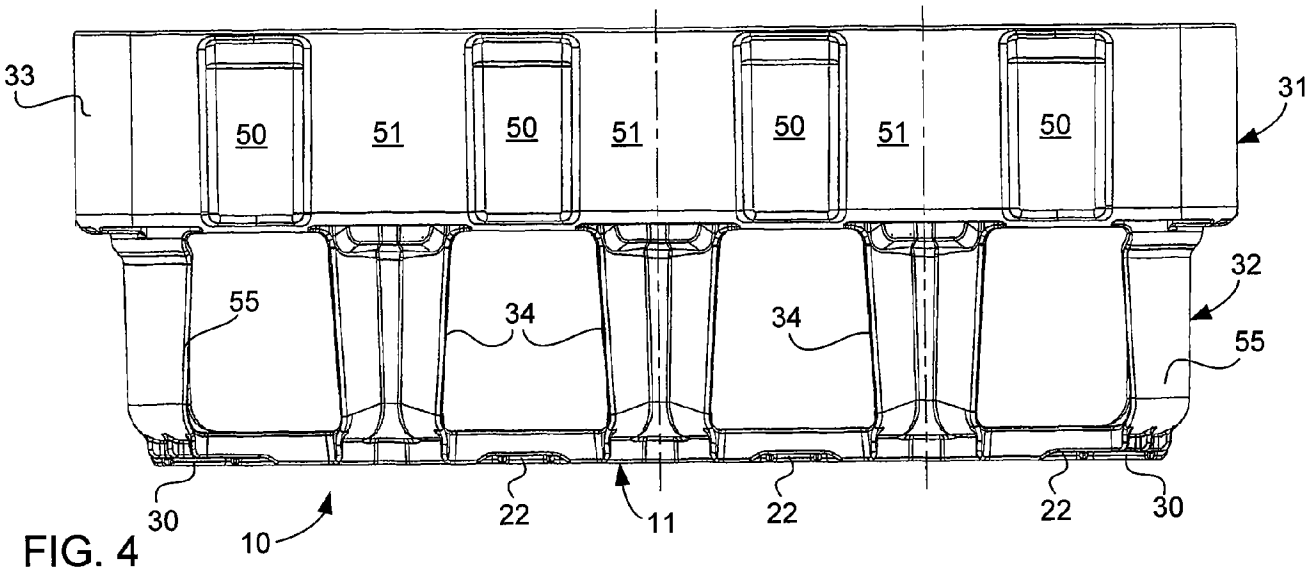
FIG. 4 is a side view in elevation of the case of FIG. 1.
Figure 5:
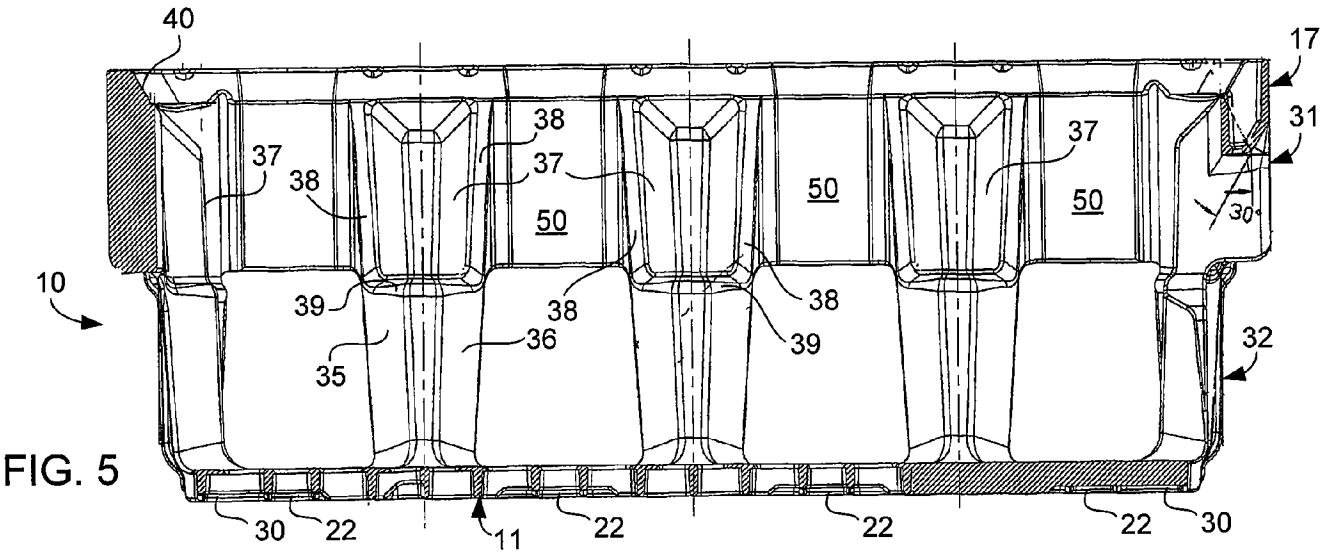
FIG. 5 is a longitudinal sectional view taken along line 5-5 in FIG. 3.
Figure 6:
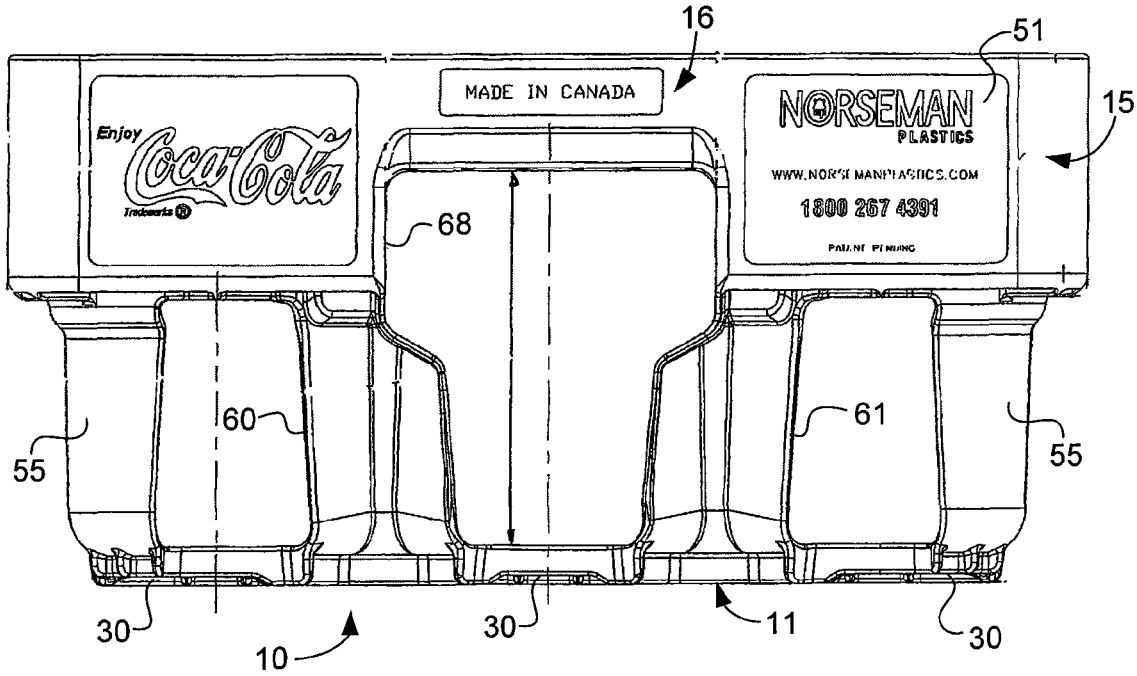
FIG. 6 is an end view in elevation of the case of FIG. 1.
Figure 7:
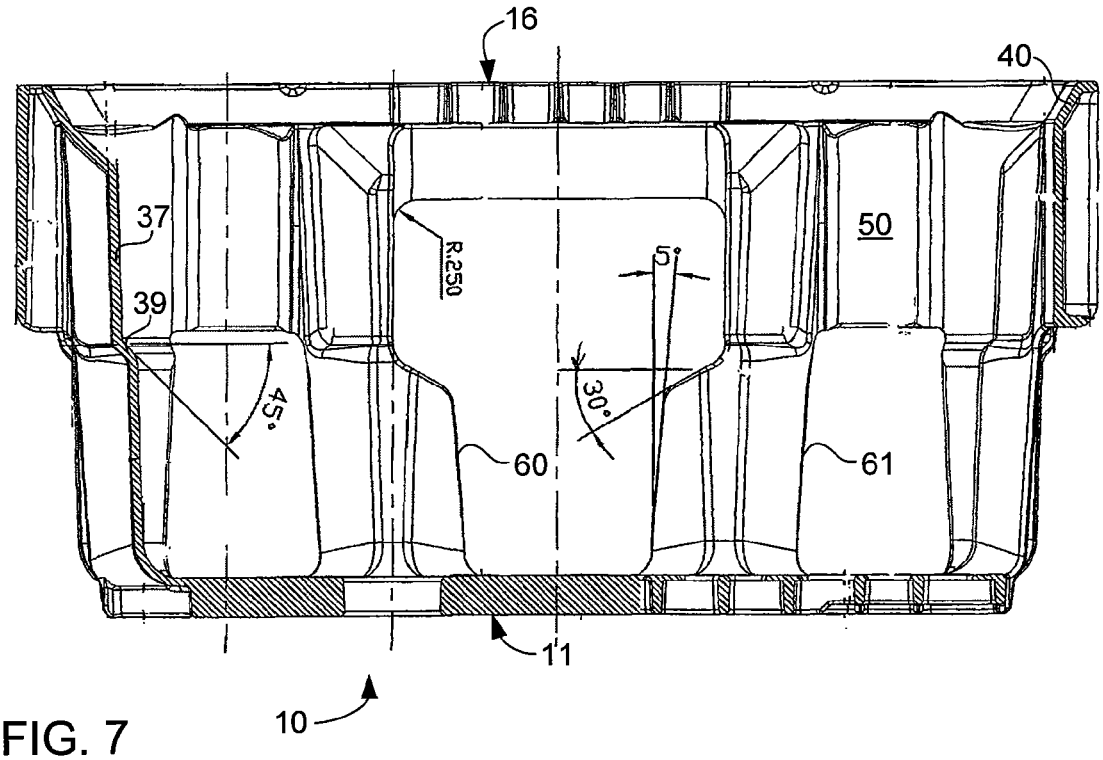
FIG. 7 is a transverse sectional view taken along line 7-7 in FIG. 3.
Figure 9:
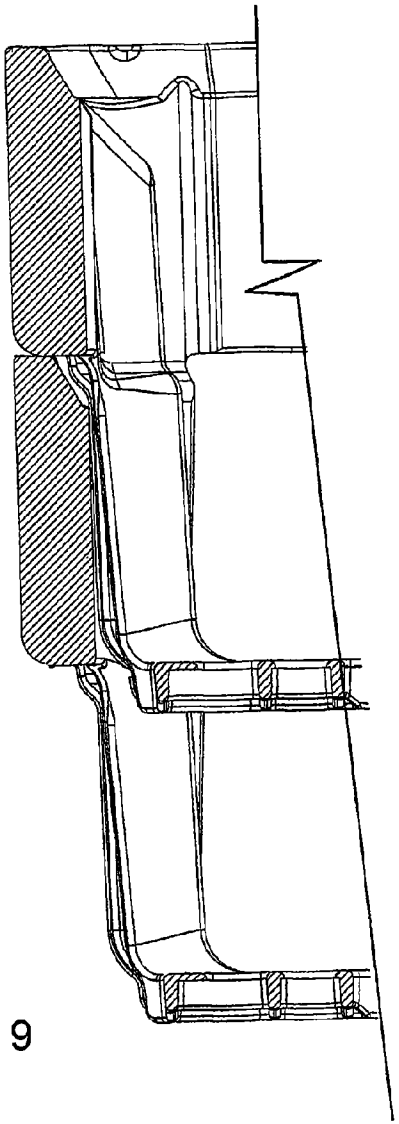
FIG. 9 is a fragmentary sectional view showing two of the cases of FIG. 1 in stacked relationship.
Figure 8:
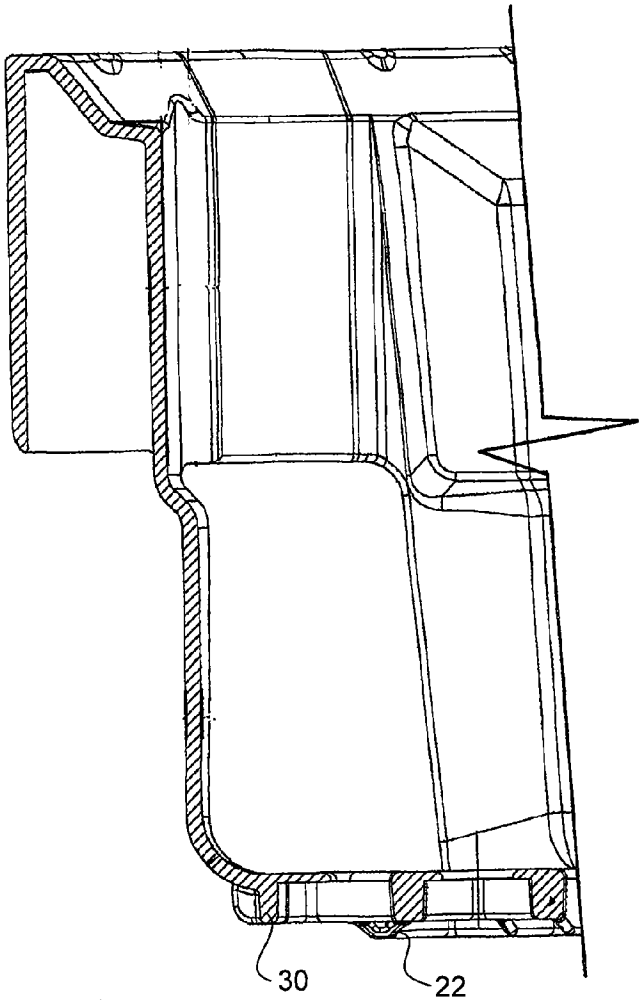
FIG. 8 is a greatly enlarged fragmentary sectional view taken along line 8-8 in FIG. 3.

The band that forms the upper section of the walls is of single wall construction, with alternating inwardly offset panels 50 and outwardly offset panels 51. The outwardly offset panels 51 extend behind or outwardly of the buttresses and have flat vertical outer surfaces to which graphics can be applied as indicated in FIG. 6, for example, if desired. The inwardly offset panels 50 are located adjacent the seating areas and are outwardly curved to accommodate the curvature of beverage containers resting on the adjacent seating area.

Outwardly curved or contoured corner straps 55 extend between the floor and the upper band at the corners of the case.

Two columns 60 and 61 and associated buttresses 62 and 63 are in each end wall, spaced equidistantly from opposite sides of the case. The confronting side edges of these two columns and associated buttresses are cut away, and the bottom of the band extending between the two columns is cut away to form the handles 16 and 17 extending across an upper midportion of respective end walls, with an enlarged opening 68 beneath the bar for easy hand access.

The construction of the upper and lower wall sections of the mid-depth case of the invention, including their vertical orientation, and the inset relation of the lower wall section relative to the upper wall section, makes the case fully nestable with like cases, i.e., it can nest within like cases and like cases can nest within it, and it also makes the case partially nestable with prior art non-nestable box-style beverage cases, i.e., it can nest within prior art cases but they cannot nest within it. Further, the case of the invention is stackable with prior art box-style cases. Thus, cases according to the invention can be stored and shipped in half the amount of space that would be required for the same number of conventional prior art box-style cases. Moreover, a substantial amount of space can be saved even when the case of the invention is mixed with conventional box-style cases.

Further, the flat vertical surfaces of the V-shaped columns provides line contact with containers resting on adjacent seating areas, providing support to the containers over a substantial part of their height in both lateral and longitudinal directions relative to the lateral and longitudinal dimensions of the case.

While particular embodiments of the invention have been illustrated and described in detail herein, it should be understood that various changes and modifications may be made in the invention without departing from the spirit and intent of the invention as defined by the appended claims.

What is claimed is:

1. A nestable mid-depth beverage case for holding containers of beverage, said case having a longitudinal axis and a lateral axis, and comprising:

a bottom wall with an outer periphery, an upper surface, a bottom surface, and a plurality of spaced apart container seating areas on said upper surface and a plurality of beverage container closure receiving recesses are formed in the bottom surface of the bottom wall of the case beneath respective seating areas for receiving the closures of beverage containers in a subjacent case when cases are stacked on top of one another, wherein:

said closure receiving recesses are each greater in diameter than the diameter of a closure, whereby each recess is incapable by itself of aligning a closure, and said recesses are offset progressively greater distances from a centerline of the associated seating area as the distance of each recess from the lateral and longitudinal axes of the case increases, and a side edge of each recess is adapted to engage a side of a closure when a case is rested on top of another case loaded with beverage containers, whereby all the recesses acting together function to align the closures of containers in a subjacent case with respect to the seating areas of an upper case;

upstanding vertically oriented sidewalls and end walls around the periphery of the bottom wall, said sidewalls and end walls each comprising an upper wall section and a lower wall section, each said wall section extending about one-half the height of the case, and said lower wall section being inset relative to said upper wall section so that one case can rest into another case up to about one-half its height, wherein:

said upper wall section comprises a continuous band extending around the periphery of the case in upwardly spaced relation to the bottom wall and having vertical inner and outer surfaces;

said lower wall section comprises a plurality of spaced apart columns connected between said band and the periphery of said bottom wall, said columns having a V-shape in transverse cross-section, with a pair of angularly divergent flat vertical surfaces facing inwardly toward respective adjacent seating areas, and an open concave outer surface;

hollow buttresses extend upwardly from upper ends of the columns in outwardly offset relationship thereto and across the inner surface of the band, said buttresses having a shape complemental to the shape of the columns and dimensioned to nest within the open concave outer surface of the columns when two cases are nested together; and a narrow, flat, generally vertical, slightly outwardly inclined ramp formed at each side of each buttress extending from the upper ends of the columns along each side of each buttress, defining a rest or guide for opposite side edges of the V-shaped columns when two cases are nested together.

2. A beverage case as claimed in claim 1, wherein:

an upper inner edge of the band is recessed outwardly, defining a space for receiving a bottom of a box-style case stacked on top of the beverage case.

3. A beverage case as claimed in claim 1, wherein:

a shoulder extends outwardly from an upper end of each column to a lower end of each associated buttress, defining a nesting stop to limit nesting engagement of the cases.

4. A beverage case as claimed in claim 1, wherein:

some of said recesses are located adjacent side and end edges of the case, and an open channel extends through said side and end edges from each of said some recesses to enable free sliding movement of closures through said channels when one case loaded with containers of beverage is slid off another case loaded with containers of beverage.

5. A beverage case as claimed in claim 1, wherein:

the band is of single wall thickness and comprises a plurality of generally parallel, vertically oriented, alternately inwardly and outwardly offset panels.

6. A beverage case as claimed in claim 5, wherein:

the inwardly offset panels are located adjacent respective seating areas and have a concave curved inner surface.

7. A beverage case as claimed in claim 1, wherein:

two columns and associated buttresses are in each end wall, spaced equidistantly from opposite sides of the case;

upper inner side edges of said two columns and confronting side edges of said associated buttresses are cut away; and a bottom portion of the band extending between said two columns is cut away to form a handle bar extending across an upper midportion of each end wall between said two columns, said cut away portion of the band and the cut away side edges of said columns and associated buttresses forming an enlarged opening beneath the bar for easy hand access.

8. A beverage case as claimed in claim 1, wherein:

an upper inner edge of the band is recessed outwardly, defining a space for receiving a bottom of a box-style case stacked on top of the beverage case.

9. A beverage case as claimed in claim 8, wherein:

a shoulder extends outwardly from an upper end of each column to a lower end of each associated buttress, defining a nesting stop to limit nesting engagement of the cases.

10. A beverage case as claimed in claim 9, wherein:

a narrow, flat, generally vertical, slightly outwardly inclined ramp is formed at each side of each buttress, defining a rest or guide for opposite side edges of the V-shaped columns when two cases are nested together.

11. A beverage case as claimed in claim 10, wherein:

some of said recesses are located adjacent side and end edges of the case, and an open channel extends through said side and end edges from each of said some recesses to enable free sliding movement of closures through said channels when one case loaded with containers of beverage is slid off another case loaded with containers of beverage.

12. A beverage case as claimed in claim 11, wherein:

the band is of single wall thickness and comprises a plurality of generally parallel, vertically oriented, alternately inwardly and outwardly offset panels.

13. A beverage case as claimed in claim 12, wherein:

the outwardly offset panels are planar and are located outwardly of respective buttresses.

14. A beverage case as claimed in claim 13, wherein:

the inwardly offset panels are located adjacent respective seating areas and have a concave curved inner surface.

15. A beverage case as claimed in claim 14, wherein:

an upper inner edge of the band is recessed outwardly, defining a space for receiving a bottom of a box-style case stacked on top of the beverage case.

16. A beverage case as claimed in claim 14, wherein:

a shoulder extends outwardly from an upper end of each buttress to a lower end of each associated column, defining a nesting stop to limit nesting engagement of the cases; and a narrow, flat, generally vertical, slightly outwardly inclined ramp is formed at each side of each buttress, defining a rest or guide for opposite side edges of the V-shaped columns when two cases are nested together.

* * * * *